United States Patent [19]

Hamilton

[11] 4,166,566

[45] Sep. 4, 1979

[54] CARTON WITH INTEGRAL RETRACTABLE SPOUT

[75] Inventor: Gordon A. Hamilton, Highland Springs, Va.

[73] Assignee: Champion International Corporation, Stamford, Conn.

[21] Appl. No.: 886,346

[22] Filed: Mar. 14, 1978

[51] Int. Cl.[2] ..... B65D 5/72

[52] U.S. Cl. ..... 229/17 R

[58] Field of Search ..... 229/17

[56] References Cited

U.S. PATENT DOCUMENTS

| | | | |
|---|---|---|---|
| 2,300,703 | 11/1942 | Ray | 229/17 R |
| 2,933,230 | 4/1960 | Yezek | 229/17 R |
| 3,064,873 | 11/1962 | Robinson et al. | 229/17 R |
| 3,081,927 | 3/1963 | Hayhurst | 229/17 R |
| 3,107,038 | 10/1963 | Kuchenbecker | 229/17 R |
| 3,147,904 | 9/1964 | Larson | 229/17 R |

*Primary Examiner*—Davis T. Moorhead
*Attorney, Agent, or Firm*—Evelyn M. Sommer

[57] ABSTRACT

A rectangular, tube like carton having four upstanding sidewalls, a base portion, and a top closure includes an improved reclosable pour spout. The top closure and spout include a pair of contiguous, triangular shaped segments which form portions of the top closure, each segment having one edge thereof extending along one half the width of a first sidewall of the carton. A second edge of each of the triangular shaped segments extends along the longitudinal axis of the top closure. The third edge of each triangular segment is hingedly connected to the top closure. An insertable tab member is hingedly attached to the one sidewall of the carton, the insertable tab being generally triangular in configuration. The top closure and spout further include two minor tabs, each being hingedly connected intermediate the insertable tab and one of the triangular shaped segments.

5 Claims, 4 Drawing Figures

CARTON WITH INTEGRAL RETRACTABLE SPOUT

BACKGROUND OF THE INVENTION

The subject invention relates to paperboard cartons, and more particularly, to paperboard cartons which may be used to contain charcoal briquets and other products of granular nature such as seed, fertilizer, dog food etc. The most common form of containers for charcoal briquets and the like, take the form of heavy duty paper bags which exhibit several shortcomings in practice. For example, the bags must generally be ripped open in order to obtain access to the contents thereof, and thus, the bags are generally not reclosable. In addition, the fact that the entire top portion of the bag is ripped open, prevents the controlled pouring of the contents thereof, and thus, spillages often occur. Another shortcoming of the currently used heavy duty bags is that they are not very sturdy, and thus when stacked, tend to become damaged, and to leak the contents thereof.

Accordingly, it is an object of the subject invention to provide a heavy duty container for charcoal briquets and other granular material which includes an easy open, and reclosable pour spout.

It is another object of the subject invention to provide a heavy duty container for charcoal briquets and other granular material which is sturdy, easily stackable, and substantially sift proof.

It is a further object of the subject invention to provide a container having the above characteristics which may be constructed from a single piece of paperboard material and may be relatively cheaply manufactured.

SUMMARY OF THE INVENTION

In accordance with the above recited objectives, the subject invention provides a heavy duty container which is substantially rectangular in configuration, and formed from a single blank of single or double wall corrugated paperboard. The subject box has a closed base portion and four upstanding wall members including a front and back wall and first and second sidewalls. The subject box also includes a top closure member having a reclosable spout. The top closure and spout include two contiguous, substantially triangular shaped segments which form portions of the top closure, each segment having one edge thereof extending along one half the width of one of the sidewalls of the carton. A second edge of each segment extends along the longitudinal axis of the top closure. The third edge of each triangular segment is hingedly connected to the top closure. An insertable tab member is hingedly connected to the first sidewall of the carton, the insertable tab being generally triangular in configuration. Preferably, the apex of the insertable tab member includes an arcuate cut for facilitating the opening of the spout. The subject top closure and spout further include two minor tabs, each of which is hingedly connected intermediate the insertable tab and one of the triangular shaped segments.

The blank for forming the subject box is a substantially rectangular substrate having a plurality of verticle and horizontal fold lines which subdivide the substrate into a plurality of panel members and closure flaps. More particularly, the subject blank includes a first side panel having a top and bottom closure flap hingedly connected to the top and bottom edges thereof. Preferably, each closure flap includes a pair of fold lines, each fold line extending from a corner of the respective closure flap adjacent the first side panel to the opposite edge of the closure flap, the fold lines of each closure flap intersecting at a point one half the length of the closure flap. A back panel is hingedly connected to the first side panel, said back panel having a top and bottom closure flap hingedly connected to the top and bottom edges thereof. The subject blank further includes a front panel having top and bottom closure flaps hingedly connected to the top and bottom edges thereof, and a glue panel hingedly connected to one side thereof. A second side panel is disposed between and hingedly connected to the front and back panels, said second side panel having top and bottom closure flaps hingedly connected to the top and bottom edges thereof. In accordance with the subject invention, the top closure flaps of the front and back panel and the second side panel combine to form the top closure portion and pour spout of the subject box. More particularly, the top closure flaps of the front and back panel each include a fold line which extends from the corner of said closure flap directly adjacent the second side panel to the opposite edge of the closure flap and away from the second side panel top closure flap, thus, defining a pair of major triangular segments each triangular segment having an edge thereof contiguous with the closure flap of the second side panel. The top closure flap of the second side panel includes a pair of fold lines and a substantially W shaped cut which subdivide the closure flap into three sections, namely, a central tab member and a pair of lateral, substantially triangular minor tabs. One edge of each minor tab forms a portion of the central tab, while another edge of each minor tab is contiguous with an edge of one of the major triangular segments of the front and back panel closure flaps. The bottom closure flaps of the first and second side panels each include a pair of fold lines which extend from the free edges of each closure flap, preferably at a point one half the length of the closure flap to the corners of the opposite edge of the closure flap. As a result, the bottom closure flaps of the respective panels can be folded to provide a substantially sift proof, closed base portion.

DESCRIPTION OF THE PREFERRED EMBODIMENTS

Figure 1:
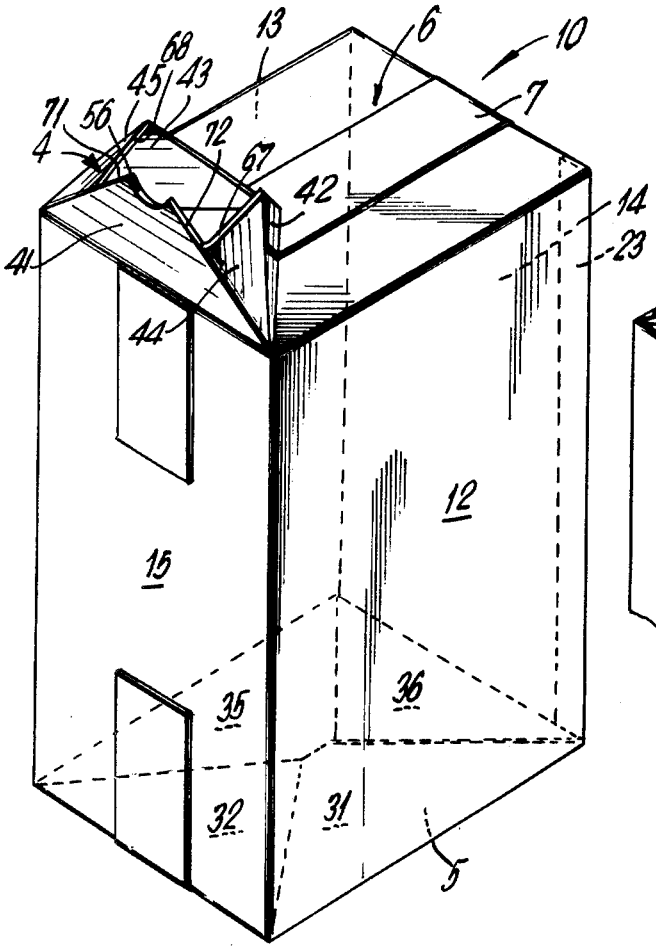
FIG. 1 is a perspective view of the subject box in which the pour spout is fully extended.
Figure 2:
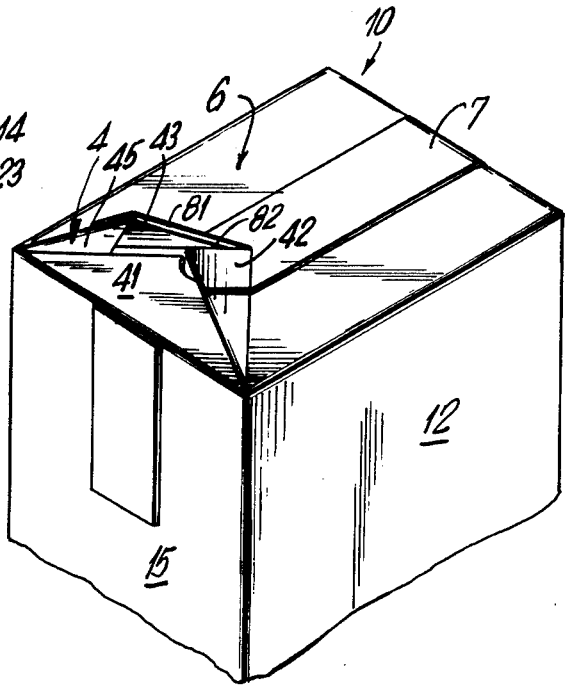
FIG. 2 is a partial perspective view of the subject box in which the pour spout thereof is partially closed.
Figure 3:
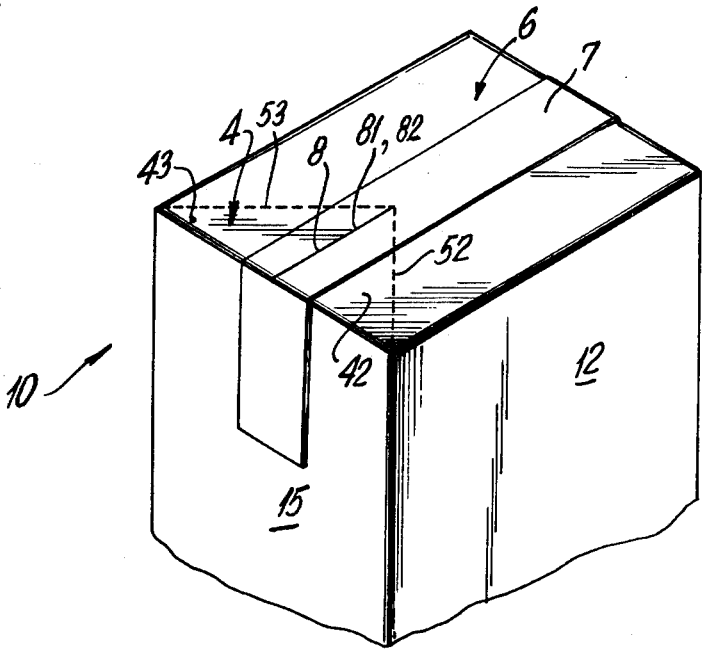
FIG. 3 is a partial perspective view of the subject box in which the pour spout thereof is completely closed and the top portion of the box is substantially closed.

Referring to FIGS. 1–3, the tubular carton of the subject invention is designated generally by reference numeral 10 and includes a closed base portion 5, a front wall 12, back wall 13, and first and second sidewalls 14 and 15, respectively. The subject carton also includes a top closure member 6 which includes a closable pour spout 4 which is adjacent side panel 15. More particularly, pour spout 4 includes an insertable, substantially triangular tab member 41, one edge of which is hingedly connected to sidewall 15. Preferably, the apex of triangular tab member 41 includes an arcuate cut 56 which facilitates the opening of the spout. The spout 4 further includes a pair of minor tabs 44 and 45 which are substantially triangular in configuration, one edge of each triangular minor tab being hingedly connected to a side edge of tab 41. Preferably, the edges of minor tabs 44 and 45 extend for only a portion of the respective edges of tab 41, said portion being on the order of 60%. As a result, tab 41 is provided with free edges 72 and 71. In addition, tabs 44 and 45 are provided with free edges 67 and 68, respectively. The spout 4 further includes a pair of major tabs 42 and 43 which are triangular in configuration, one edge of each major tab being hingedly connected to an edge of one of the minor tabs. Another edge of each of said major portions 42 and 43 extends along the longitudinal axis of top member 6.

As illustrated in FIGS. 1–3, the spout 4 is closed to form completely closed closure member 6 by pushing tab 41 inwardly, and then folding minor tabs 44 and 45, and segments 42 and 43 thereover. As shown in FIG. 3, in the closed position the third edge of major tabs 42 and 43 extend along the width of sidewall 15, each edge extending approximately one half the width of said wall.

Figure 4:
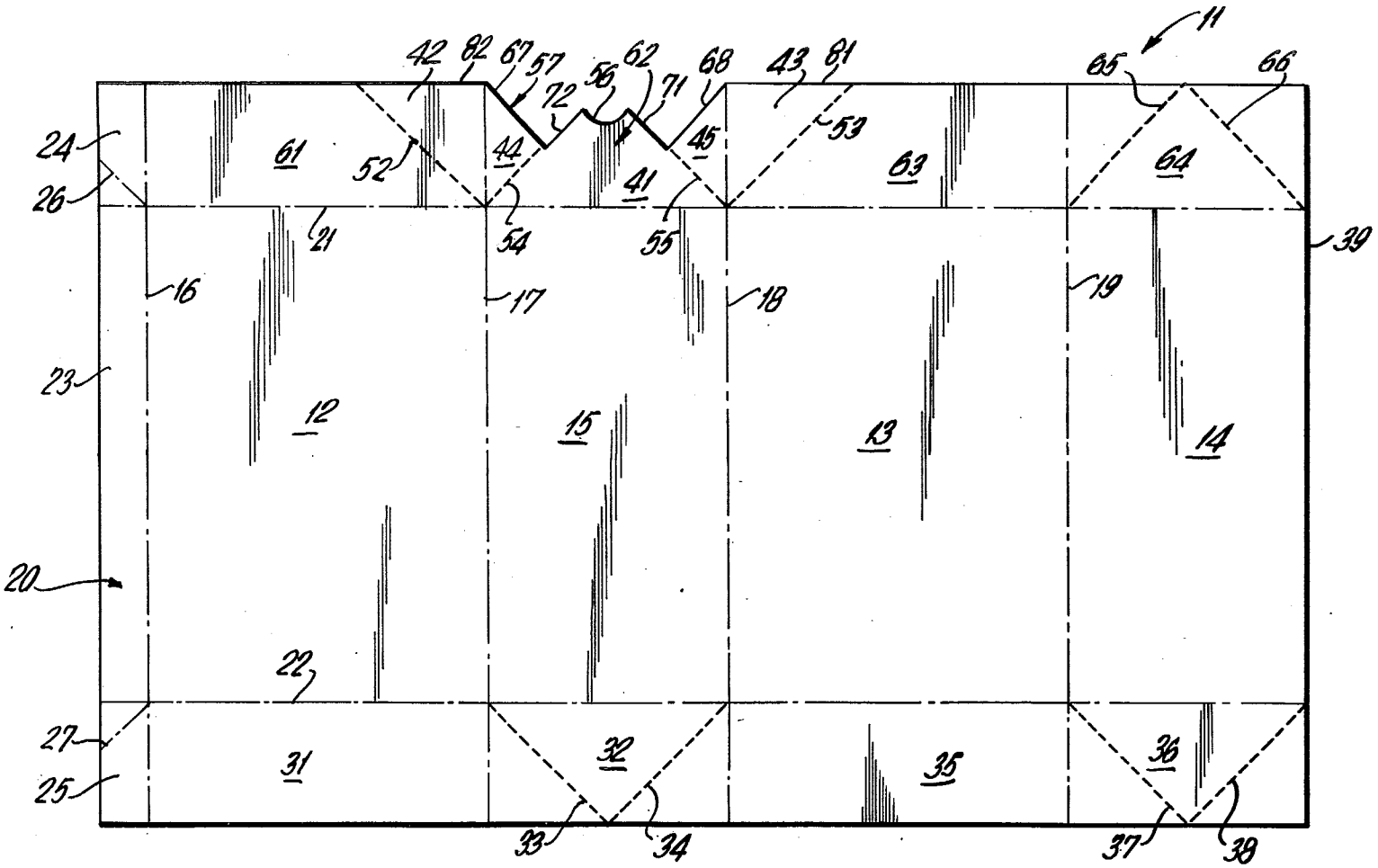
FIG. 4 is a plan view of the blank for forming the box of the subject invention.

Turning now to FIG. 4, the blank for forming the subject container comprises a generally rectangular substrate 11 which may be a single or double wall corrugated paperboard. Substrate 11 includes a plurality of horizontal fold lines, namely, 21 and 22, and vertical fold lines, namely 16, 17, 18 and 19, and cuts, namely, 56 and 57, which subdivide the substrate 11 into a plurality of panel members and closure flaps. More particularly, the substrate 11 includes a first side panel 14 which is defined between horizontal fold lines 21 and 22 and between vertical fold line 19 and lateral free edge 39. Hingedly connected to first side panel 14 along horizontal fold lines 21 and 22 are top and bottom closure flaps 64 and 36, respectively. In the preferred embodiment of the subject invention, each closure flap includes a pair of fold lines which subdivide the respective closure flaps into three substantially triangular segments. More particularly, closure flap 64 includes fold lines 65 and 66 which extend from the corners of closure flap 64 immediately adjacent first side panel 14 to the opposite edge of closure panel 64. Fold lines 65 and 66 intersect at a point approximately one half the length of closure flap 64. Similarly, closure flap 36 includes a pair of fold lines 37 and 38 which extend from the corners of flap 36 immediately adjacent side panel 14 to the opposite edge of closure flap 36, fold lines 37 and 38 intersecting at a point approximately one half the length of closure flap 36.

A back panel 13 is hingedly connected to first side panel 14 along vertical fold line 19. A bottom closure flap 35 is hingedly connected to back panel 13 along horizontal fold line 22, and a top closure flap 63 is hingedly connected to back panel 13 along horizontal fold line 21. A second side panel 15 is hingedly connected to back panel 13 along vertical fold line 18. Top and bottom closure flaps 62 and 32 are hingedly connected to second side panel 15 along horizontal fold lines 21 and 22, respectively. In the preferred embodiment of the subject invention, closure flap 32 includes a pair of fold lines 33 and 34 which extend from the corners of closure flap 32 immediately adjacent second side panel 15 to the opposite edge of closure flap 32, lines 33 and 34 intersecting at a point approximately one half the length of closure flap 32.

A front panel 12 is hingedly connected to second side panel 15 along vertical fold line 17. Top and bottom closure flaps 61 and 31 are hingedly connected to front panel 12 along horizontal fold lines 21 and 22, respectively.

Substrate 11 further includes a lateral glue flap 20 which extends along the entire side of the substrate along vertical fold line 16. It will be noted that flap 20 is divided by horizontal fold lines 21 and 22 into three portions, namely a central portion 23, and top and bottom portions 24 and 25, respectively. It will further be noted that glue flap portions 24 and 25 include angular fold lines 26 and 27, respectively, which facilitate the assembling of the subject carton.

In accordance with the subject invention, closure flaps 61, 41 and 63 form the pour spout 4 and top closure 6 of the subject carton. Referring to FIG. 4, top closure flap 63 includes a fold line 53 which extends from the corner of closure flap 63 bounded by closure flap 41, second side panel 15 and back panel 13 to the opposite edge of closure flap 63 at a point intermediate the length of closure flap 63. Preferably, fold line 53 forms a 45° angle with horizontal fold line 21. As a result, triangular segment 43 is provided, segment 43 being substantially an isosceles right triangle. Similarly, top closure flap 61 includes a fold line 52 which extends from the corner of closure flap 61 bounded by closure flap 41, second side panel 15 and front panel 12 to the opposite edge of closure flap 61 at a point intermediate the length of flap 61. Preferably, fold line 52 forms a 45° angle with horizontal 21, thus, forming triangular segment 42 which is substantially an isosceles right triangle.

Further referring to FIG. 4, top closure flap 62 includes a combination of cuts and fold lines which subdivide flap 62 into three segments. More particularly, closure flap 62 includes a fold line 54 which extends from the corner of closure flap 62 adjacent panels 12 and 14 and closure flap 61 to an intermediate portion of closure flap 62. Preferably, fold line 54 forms a 45° angle with horizontal fold line 21. Similarly, closure flap 62 includes another fold line 55 extending from the corner of flap 62 adjacent panels 14, 13 and closure flap 63 to an intermediate portion of flap 62. Preferably, fold line 55 forms a 45° angle with horizontal fold line 21. Closure flap 62 further includes a substantially W shaped cut 57 along its top edge which along with fold lines 54 and 55 combine to form a pair of minor triangular members 44 and 45 and a central triangular tab 41. As indicated above, it is preferable that the apex of triangular tab 41 include an arcuate cut 56 for facilitating the opening and closing of the pour spout 4 to be formed. In the preferred embodiment of the subject invention, minor segments 44 and 45 and central tab 41 are substantially isosceles right triangles.

In forming carton 10 the various panels and closure flaps of substrate 11 are folded along their respective fold lines and sealed along manufacturer's glue flap 20. As shown in FIGS. 1 and 4, bottom closure flaps 31, 32, 35 and 36 combine to form closed base portion 5, and top closure flaps 61, 62, 63 and 64 combine to form top closure 6 and pour spout 4. In addition, means for sealing the subject carton in the assembled position is provided. As shown in the figures, said means may comprise a tape 7 which is disposed over closed spout 4 and around top closure 6, first side panel 12, base portion 5, and second side panel 15. Because of the particular arrangement of the respective closure flaps with tape 7, the subject carton is substantially sift proof.

Referring to FIG. 4, it will be noted that after sealing, carton 10 may be opened by putting a slit 8 in tape 7 with a razor or other sharp instrument. Slit 8 extends along the longitudinal axis of top closure 6 and exposes edges 81 and 82 of major tabs 43 and 42, respectively, of spout 4. To open the spout, tabs 42 and 43 are pulled upwardly (see FIG. 2), and then inserted tab 41 is pulled outwardly (see FIG. 1). The spout may then be easily closed by reinserting tab 41 and folding over tabs 42 and 43.

In summary, the subject invention provides a new container for charcoal briquets and other granular material. Instead of tear-open heavy duty bags which are currently used for such purpose, the subject container is a tubular carton made from a single blank of single or double wall corrugated paperboard. The subject carton includes a reclosable spout which enables the contents thereof to be easily poured. In addition, the carton itself may be resealed after original use. Because of the carton's substantially rectangular configuration, it may be efficiently stacked. In addition, because of its particular construction, the subject carton is substantially sift proof. While having the above qualities, the subject carton is simple in construction and relatively inexpensive to manufacture.

While the preferred embodiment of the subject invention has been described and illustrated, it would be obvious that various changes and modifications can be made therein without departing from the spirit of the invention which should be limited only by the scope of the appended claims.

What is claimed is:

1. A blank for forming a rectangular tube like container having a closed base portion, four upstanding wall members including a front and back wall and a first and second sidewall, and a top closure member having a reclosable spout portion, said blank comprising a substantially rectangular substrate of a single or a double wall corrugated paperboard, said substrate including a first side panel having a top and bottom closure flap hingedly connected to the top and bottom edges thereof, said bottom closure flap having a pair of fold lines, each fold line extending from a corner of the bottom closure flap, immediately adjacent said first side panel, to the opposite edge of said bottom closure flap, the fold lines of said bottom closure flap intersecting at a point approximately one half the length of said bottom closure flap; a back panel hingedly connected to said first side panel, said back panel having a top and bottom closure flap hingedly connected to the top and bottom edges thereof; a front panel having top and bottom closure flaps hingedly connected to the top and bottom edges thereof and a glue panel hingedly connected to one lateral edge thereof; a second side panel disposed between and hingedly connected to said front and back panels, said second side panel having top and bottom closure flaps hingedly connected to the top and bottom edges thereof; the top closure flap of said second side panel having a pair of fold lines each of which extends from a corner of said closure flap immediately adjacent said second side panel to an intermediate point of said closure flap, said top closure flap further including a substantially W shaped cut along its top portion, said W shaped cut and said fold lines defining first and second substantially triangular minor tabs and a central substantially triangular insert tab disposed between said minor tabs; one edge of said insert tab being hingedly connected to said second side panel, the second and third edges of said insert tab each being hingedly connected to an edge of one of said minor tabs; said back panel top closure flap having a fold line extending from the corner of said back panel top closure flap, bounded by said back panel and said second side panel, to the free edge of said back panel top closure flap, thus defining an edge of a first triangular major segment, another edge of which is hingedly connected to an edge of said first minor tab, the third edge of which comprises a portion of the free edge of said back panel top closure flap; said front panel top closure flap having a fold line extending from the corner of said front panel top closure flap bounded by said front panel and said second side panel to the free edge of said front panel top closure flap, thus, defining an edge of a second triangular major segment, another edge of which is hingedly connected to said second minor tab, the third edge of said second major segment comprising a portion of free edge of said front panel top closure flap.

2. A blank for forming a rectangular tube like container as recited in claim 1 in which the apex of said central insert tab includes an arcuate cut.

3. A blank for forming a rectangular tube like container as recited in claim 1 in which said first and second major segments is substantially an isosceles right triangle.

4. A blank for forming a rectangular tube like container as recited in claim 1 in which each of said first and second minor tabs is substantially an isosceles right triangle.

5. A blank for forming a rectangular tube like container as recited in claim 1 in which said insert tab is substantially as isosceles right triangle.

* * * * *